United States Patent [19]

Deluty

[11] 4,010,948

[45] Mar. 8, 1977

[54] PULL TYPE FRICTION EXERCISING DEVICE

[76] Inventor: Michael E. Deluty, 37 Addington Road, Brookline, Mass. 02146

[22] Filed: Sept. 18, 1975

[21] Appl. No.: 614,610

Related U.S. Application Data

[63] Continuation-in-part of Ser. No. 579,704, May 21, 1975, which is a continuation-in-part of Ser. No. 481,907, June 21, 1974, Pat. No. 3,885,789.

[52] U.S. Cl. ..... 272/133; 188/65.3; 272/140

[51] Int. Cl.[2] ..... A63B 21/00

[58] Field of Search ..... 272/136, 138, 142, 133; 267/69; 188/65.5, 65.4, 65.3; 66/146; 242/107.3, 107.15; 24/115

[56] References Cited

UNITED STATES PATENTS 3,544,105 12/1970 Latta ..... 272/133

*Primary Examiner*—Richard C. Pinkham
*Assistant Examiner*—William R. Browne
*Attorney, Agent, or Firm*—Thompson, Birch, Gauthier & Samuels

[57] ABSTRACT

The exercising device has a housing which is attached to a stationary surface. A cord which has a hand grip on its free end can be pulled out of the housing against the adjustable internal resistance of the exercising device. A spring-powered cord retractor reel rewinds the cord back into the housing when the cord is released. The cord runs from the retractor reel around a plurality of sequentially arranged capstans and then out of the housing. The internal resistance on the cord is preset with manually operated push buttons which lock a selected number of capstans so that they will not rotate in the unwind direction. The remaining capstans are permitted to freewheel in the unwind direction. The push buttons can be set to produce a wide variety of cord resistance force levels.

8 Claims, 5 Drawing Figures

PULL TYPE FRICTION EXERCISING DEVICE

CROSS-REFERENCE TO RELATED APPLICATIONS

This application is a continuation-in-part of application Ser. No. 579,704, filed May 21, 1975, which was a continuation-in-part of application Ser. No. 481,907, filed June 21, 1974 (issued as U.S. pat. No. 3,885,789 on May 27, 1975).

BACKGROUND OF THE INVENTION

Previous exercising devices of this type have usually taken the form of complex mechanisms, or have taken the form of simple mechanisms employing friction brake shoes acting directly on the pull cord. The complex mechanisms are relatively expensive to construct. The simple mechanisms wear out the cord when high friction force loads are applied against the cord.

Accordingly, it is an object of this invention to provide an exercising device which is a simple mechanism, which is inexpensive to construct, and which does not apply friction brake shoes against the pull cord.

A further object of this invention is to provide an exercising device on which the operator can manually select a variety of specific pull cord resistance force levels.

A still further object of this invention is to provide an exercising device which the operator can utilize in a true exercising motion as if he were lifting a barbell or a dumbbell.

SUMMARY OF THE INVENTION

The exercising device comprising the preferred embodiment of this invention has a hollow housing in which a rotatably mounted cord retractor reel is spring-loaded in the rewind direction. A flexible cord is attached to the retractor reel and extends out of the housing where it is fitted with a hand grip. When little or no pulling force is exerted by the operator on the hand grip, the retractor reel rewinds the cord back into the housing.

When the operator pulls on the hand grip, the outward pulling force on the cord is resisted by a combination of two mechanisms mounted within the housing. Both of these mechanisms can be adjusted to produce various levels of resistance. The first resisting mechanism is the cord retractor reel which continuously produces a small biasing force on the cord in the rewind direction. This force can be adjusted by tightening or loosening the retractor reel spring. The second and more powerful mechanism which resists the outward pull on the cord is a plurality of lockable capstans. This second mechanism applies force to the cord only when the cord is being pulled out of the housing (unwound) by the operator, and applies no force to the cord when the cord is being rewound back into the housing by the retractor reel.

After the cord passes from the retractor reel, it is led to and is wrapped at least partially around each of the capstans in sequence. The cord is then led out of the housing. The capstans can be individually locked in a stationary position or unlocked to freewheel in the unwind direction. When stationary, each capstan exerts frictional force on the cord to oppose its being pulled out of the housing. Whether locked or unlocked, the capstans are permitted to freewheel in the rewind direction.

The stationary capstans cannot exert frictional force on the cord unless the cord which is wrapped around the stationary capstans is pulled tightly in both directions. Therefore, the retractor reel has two functions. First, when there is no outward pull on the cord, the retractor reel rewinds the cord into the housing. Second, when there is an outward pull on the cord, the retractor reel opposes the outward pull and thereby pulls the cord tightly against the stationary capstans to cause them to be effective.

At all times, the retractor reel urges the cord in the rewind direction and the capstans freewheel as the cord rewinds. At operator-selected times, one or more capstans can be locked into their operative stationary positions to cooperate with the retractor reel so that both mechanisms combine to resist the pull of the cord out of the housing by the operator.

DESCRIPTION OF THE PREFERRED EMBODIMENT

Figure 1:
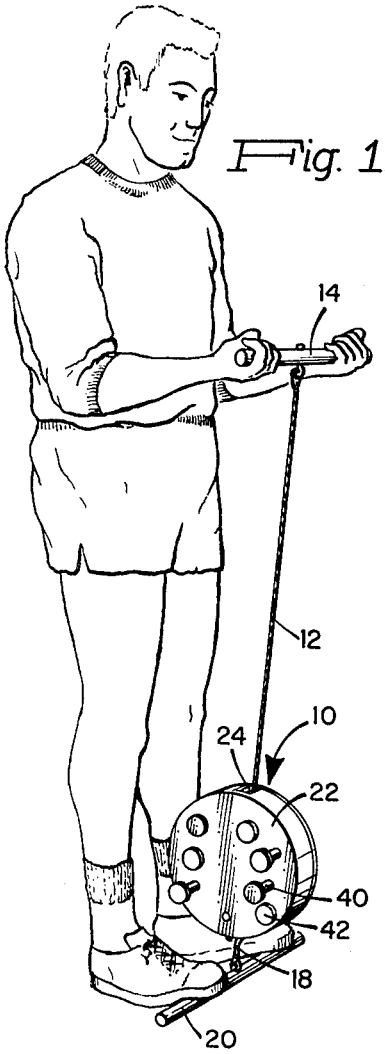
FIG. 1 is a perspective view of the exercising device of the preferred embodiment of this invention showing an operator holding the hand grip and pulling the cord out of the housing.

FIG. 1 shows a human operator performing a curling exercise with the exercising device 10 of this invention. The curling exercise is usually performed with a barbell and it is the purpose of FIG. 1 to show one example of how exercising device 10 can be substituted for a barbell in weight training. The operator simply pushes the appropriate buttons to set the desired "weight" on the device and then uses the exercising device as if it were a barbell weighing the set amount.

Exercising device 10 is provided with a flexible pull cord 12, preferably made of nylon, and a detachable hand grip 14. Various different types of hand or other grips can be attached to the end of cord 12 in order to meet the requirements of various exercise routines. Examples of different grips include double grips, bar grips, loop grips, grips to fit the operator's head, and grips to fit the operator's feet. The exercising device of this invention is not limited to any specific type of grip attached to the end of pull cord 12.

Figure 2:
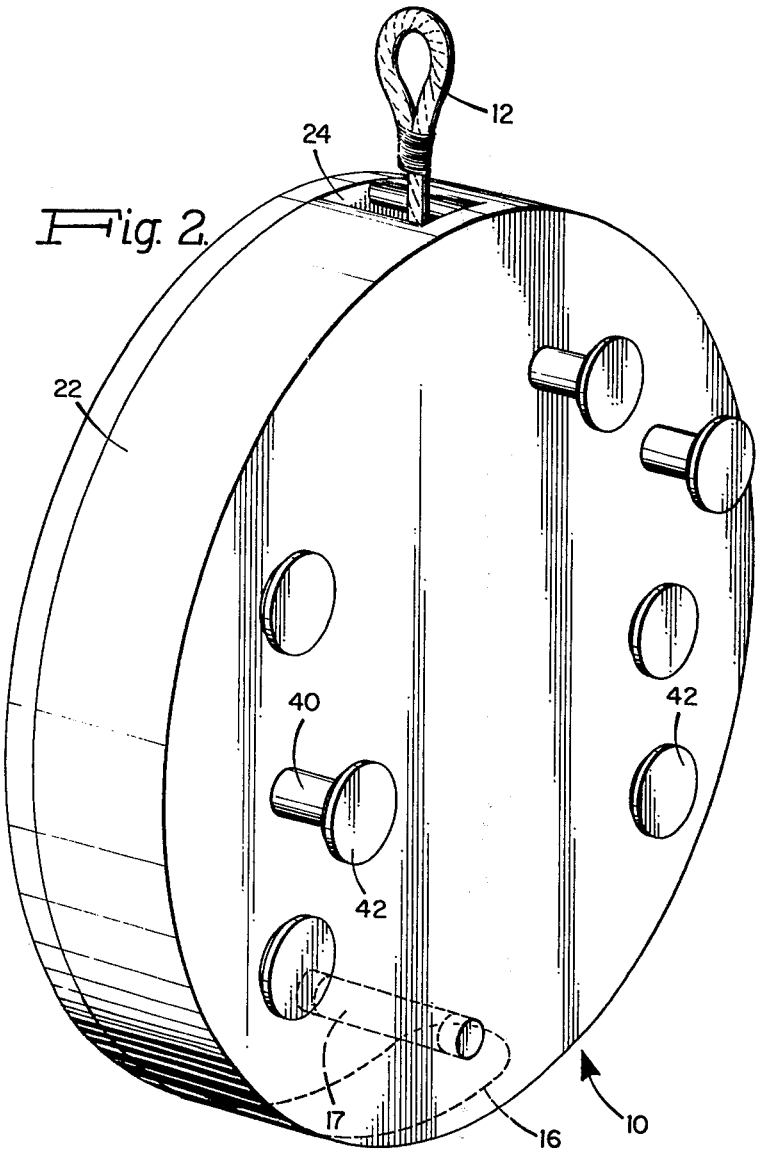
FIG. 2 is a perspective view of the exercising device of FIG. 1 showing details of the housing exterior.

In order to hold the exercising device 10 in a stationary position (which is usually preferred), the exercising device may be provided with various fittings or apertures to which a short length of line 18 can be attached. For example, FIG. 2 shows an aperture 16 and an interior stanchion 17 over which the eye of line 18 can be looped. Line 18 can then be attached to a foot rest 20, or to a wall fitting, or to a ceiling fitting, or to other fixed supports. It will be understood that a wide variety of such fittings is contemplated and this invention is not limited to any specific type or location of fitting, or any specific type or location of line, or any specific type or location of foot rest or other fixed support.

Figure 3:
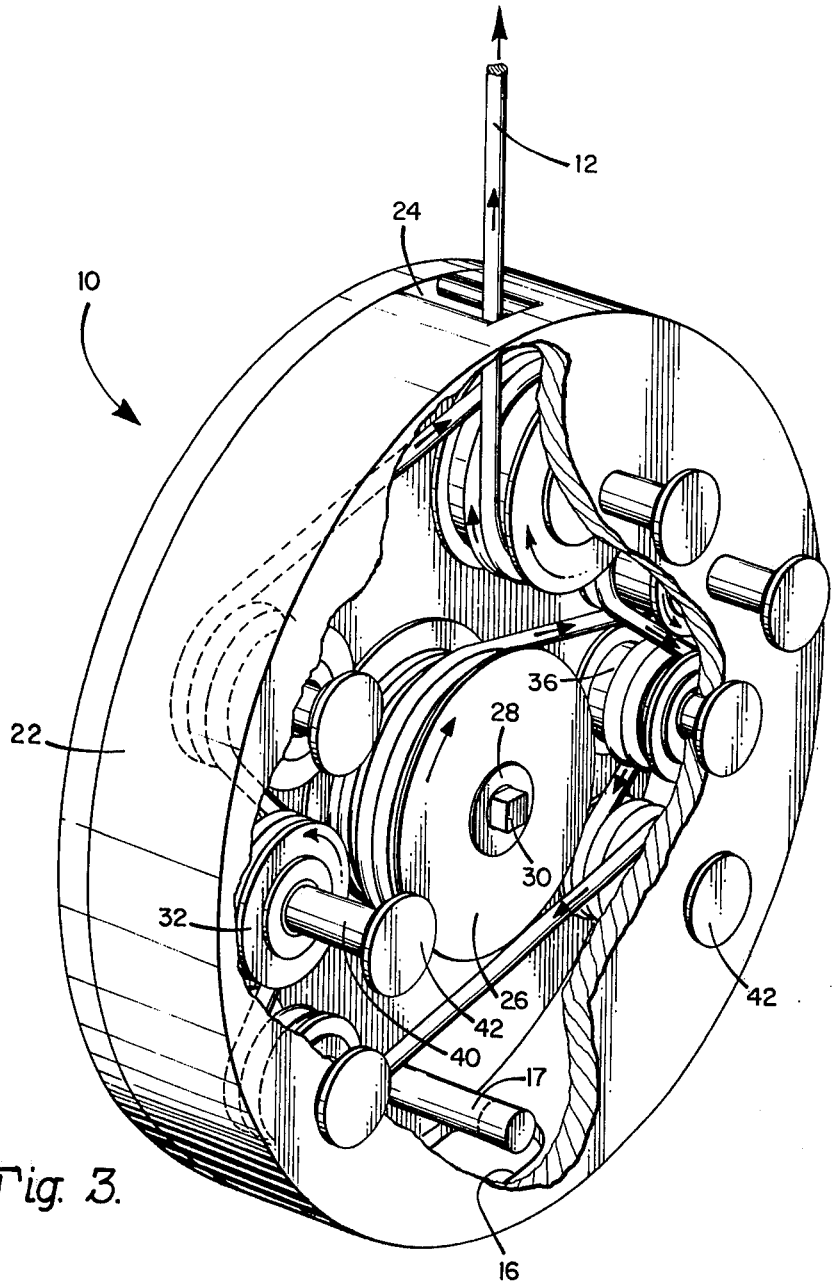
FIG. 3 is a perspective view of the exercising device of FIG. 2 showing the housing interior and the mechanism mounted therein.

Referring now to FIGS. 2 and 3, it will be seen that the exercising device 10 has a hollow two part housing 22 which is bolted or otherwise fastened together and which has a cord opening 24 through which pull cord 12 extends. The outer end of cord 12 is fitted with hand grip 14 and the inner end of cord 12 is fixed to and is wrapped several times around retractor reel 26. Retractor reel 26 is rotatably mounted in the housing on an unshown shaft and is held thereon against axial displacement by washer 28 and bolt 30. The reel is spring-powered in the counter-clockwise or rewind direction. Preferably, retractor reel 26 exerts a continuous rewind force on the cord of approximately 5 to 10 lbs. This force level can be adjusted by modifying the spring tension. Thus, whenever the operator releases hand grip 14, or exerts less than the retractor reel rewind force, cord 12 will be drawn into housing 22 through opening 24 and will be rewound on reel 26. The size of hand grip 14 prevents the outer end of cord 12 from being drawn entirely into housing 22 through opening 24.

In order to provide a substantial force on the cord to resist the operator's outward pull on the cord, a plurality of capstans 32 are mounted within housing 22. The capstans have an inoperative mode in which they freewheel in both directions, and have an operative mode in which they are locked against rotation in the unwind direction while being preferably free to rotate in the rewind direction. Alternatively, a less preferred arrangement is to lock the capstans against rotation in either direction in the operative mode.

Figure 4:
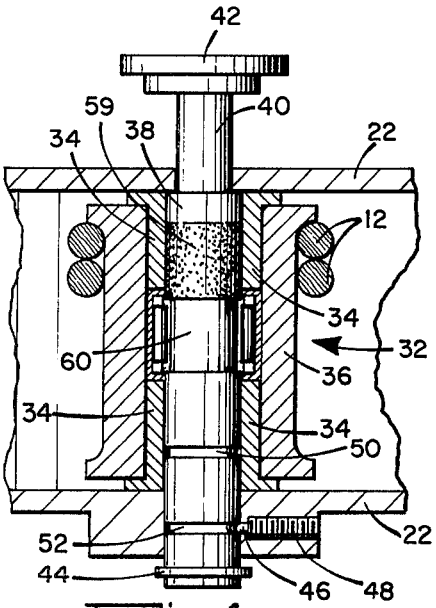
FIG. 4 is a section view of a capstan showing the push button raised and the clutch disengaged.
Figure 5:
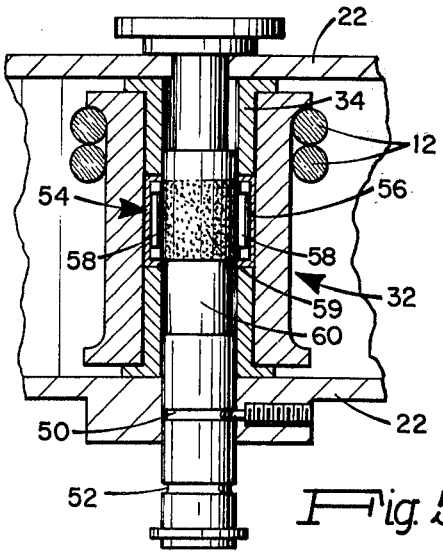
FIG. 5 is a section view of the capstan of FIG. 4 showing the push button lowered and the clutch engaged.

Capstans 32 have stationary central shafts 34 mounted in housing 22 parallel to the unshown central shaft of retractor reel 26. Each of the plurality of capstan shafts 34 is parallel to the other capstan shafts and they are all spaced apart laterally. The central capstan shafts 34 may be full shafts or may take the form of two axially aligned, spaced-apart stub shafts having oil-less bearing surfaces as shown in FIGS. 4 and 5. Capstans 32 have flanged spools 36 which are rotatably mounted on central shafts 34 and can rotate in both directions. The upper and lower flanges confine the cord 12 and restrain it against winding off the spool 36 at the top and bottom thereof.

The capstans each have an independent manually operated locking means for locking and unlocking the capstan against rotation in the unwind or outward direction. Preferably, the capstan is always permitted to freewheel in the rewind or inward direction. The specific nature of the locking means employed with the capstan is not critical to this invention and can take many forms.

The locking means shown in the drawings has a lowered locked position and a raised unlocked position. The locking means includes a locking shaft 38 which has a large diameter throughout most of its length and has a smaller diameter neck 40. Shaft 38 is telescopically mounted within capstan shaft 34 and is keyed thereto to prevent relative rotation. A push button 42 is mounted at the upper end of neck 40 to move locking shaft 38 downwardly within limits, and a retaining ring 44 is mounted at the lower end of locking shaft 38 to prevent the shaft from moving too far upwardly. A spring-loaded ball element 46 is slidably contained within a small bore formed in housing 22. Ball element 46 is retained therein by set screw 48 which can be turned to vary the spring tension on the ball element 46. Locking shaft 38 is provided with two axially spaced-apart circumferential grooves 50 and 52. When the locking shaft 38 is pressed downwardly into its operative mode, ball element 46 seats in groove 50 to maintain the shaft in position (see FIG. 5). When locking shaft 38 is lifted upwardly into its inoperative mode, ball element 46 seats in groove 52 (see FIG. 4). The locking shaft 38 can be axially shifted either entirely by use of push button 42 or by pushing on both ends of shaft 38.

The locking mechanism will now be described in detail. The clutch mechanism 54 includes a clutch housing 56 which is fixed to and rotates with the capstan spool 36. Axially oriented rollers 58 are mounted in the clutch housing 56 and incorporate internal ratchets which permit the rollers 58 to rotate in one direction only. The locking shaft 38 has a reduced diameter central portion 60 which does not contact the clutch rollers 58 in the inoperative mode (FIG. 4) and, therefore, the capstan spool 36 freewheels in both directions. When push button 42 is depressed, the one-way clutch rollers 58 contact a friction material-covered surface area 59 on the large diameter portion of shaft 38 (FIG. 5) and, therefore, the capstan spool rotates in the rewind direction only.

FIG. 3 shows how cord 12 is affixed to retractor reel 26 and runs sequentially to each of the capstans. The cord is wrapped anywhere from a fraction to one or more full turns around each capstan spool 36 and then is led out of the housing through opening 24 which has smooth rounded surfaces to reduce friction on the cord.

The capstan spools 36 may have similar or different spool diameters. It will be understood that each stationary capstan can be indepedently locked to produce a retarding force on the cord, which force level is affected by, among other factors, the cord material, diameter and texture, the capstan diameter and surface texture, the length of surface contact of cord on the capstan, and the back tension on the cord.

In order to use the exercising device of this invention, the operator first determines the total force level that he wants to be applied against the cord by the device. Then, he depresses the appropriate push buttons 42 in order to lock the desired combination of capstans in their operative mode. The device has been previously calibrated and the push buttons are marked with their force levels at the factory. The locked capstans and the unlocked capstans are all free to rotate in the rewind direction.

The device is then anchored to a fixed support and the hand grip is pulled by the operator away from the housing by using a pulling force exceeding that of the preset internal retarding force. When the operator reduces his pulling force below that of the retractor reel, the cord smoothly rewinds back into the housing. In this fashion, the operator can exercise slowly or rapidly and can adjust the cord retarding force level quickly and easily.

The above description obviously suggests many possible variations and modifications of this invention which would not depart from its spirit and scope. It should be understood, therefore that the invention is not limited in its application to the details of structure specifically described or illustrated and that within the scope of the appended claims, it may be practiced otherwise than as specifically described or illustrated.

I claim:

1. An exercising device comprising:

a. a housing having a hollow interior and a cord opening:

b. a cord retractor reel mounted for rotation within said housing;

c. rewind means for continuously urging said retractor reel in the rewind direction;

d. a plurality of capstans all mounted in fixed locations within said housing, the axis of each said capstan being spaced from the axis of said cord retractor reel and from the other said capstans, said capstans all freewheeling in the rewind direction;

e. manually operated locking means associated with said plurality of capstans for selectively locking one or more of said capstans against rotation in the unwind direction in the operating mode, and for selectively unlocking one or more of said capstans to permit freewheeling in the unwind direction in the inoperative mode;

f. a flexible cord fixed to and wrapped around said retractor reel, said cord running from said reel sequentially to and being wrapped at least partially around each said capstan, said cord running from the sequentially last of said capstans out of said housing through said cord opening; and g. said rewind means and said locked capstans cooperating to apply a retarding force to said cord to oppose an exteriorly applied manual force pulling said cord in the unwind direction, and said rewind means applying a rotational force on said retractor reel to pull said cord in the rewind direction in the absence of an exteriorly applied manual force on said cord.

2. The exercising device of claim 1 wherein said cord retractor reel rewind means includes a coiled spring.

3. The exercising device of claim 1 wherein said locking means unlocks said capstans to permit freewheeling in both directions in the inoperative mode.

4. The exercising device of claim 1 wherein said locking means unlocks said capstans to permit freewheeling in the rewind direction in the operative mode.

5. The exercising device of claim 1 wherein said capstans have diameters of different sizes.

6. The exercising device of claim 1 wherein said locking means includes a clutching mechanism having a manually operated engagement button.

7. The exercising device of claim 6 wherein said clutching mechanism is engaged by manually positioning said button in the lowered position, and said clutching mechanism is disengaged by manually positioning said button in the raised position.

8. The exercising device of claim 1 wherein the axis of each said capstan is parallel to and is spaced laterally from the axis of said cord retractor reel and from the other said capstans.

* * * * *